US007465267B2

(12) United States Patent
Goodrich

(10) Patent No.: US 7,465,267 B2
(45) Date of Patent: Dec. 16, 2008

(54) PLEATING SYSTEM

(76) Inventor: David P. Goodrich, 14 Ox Hill Rd., Newtown, CT (US) 06470

( * ) Notice: Subject to any disclaimer, the term of this patent is extended or adjusted under 35 U.S.C. 154(b) by 81 days.

(21) Appl. No.: 11/041,353

(22) Filed: Jan. 24, 2005

(65) Prior Publication Data

US 2005/0282694 A1 Dec. 22, 2005

Related U.S. Application Data

(60) Provisional application No. 60/538,633, filed on Jan. 23, 2004.

(51) Int. Cl.
*B31F 1/10* (2006.01)

(52) U.S. Cl. ..... 493/434; 493/424; 493/435; 493/442; 493/941

(58) Field of Classification Search ..... 493/434, 493/424, 442, 435, 941; 223/28; 428/181
See application file for complete search history.

(56) References Cited

U.S. PATENT DOCUMENTS 2,329,789 A * 9/1943 Schank et al. ..... 72/187
2,771,119 A * 11/1956 Hockett et al. ..... 493/397
2,774,525 A * 12/1956 Angevine, Jr. ..... 223/32
2,874,754 A * 2/1959 Mason et al. ..... 428/182
3,392,843 A * 7/1968 Mumby ..... 210/457
3,998,600 A * 12/1976 Wallis ..... 428/595
4,012,932 A * 3/1977 Gewiss ..... 72/187
4,181,070 A * 1/1980 Robbins et al. ..... 493/287
4,798,575 A * 1/1989 Siversson ..... 493/346
5,015,317 A * 5/1991 Corey et al. ..... 156/197
6,290,635 B1 * 9/2001 Demmel et al. ..... 493/399

* cited by examiner

*Primary Examiner*—Hemant M. Desai
(74) *Attorney, Agent, or Firm*—Sheldon H Parker

(57) ABSTRACT

The present invention provides a method and apparatus for pleating paper. The apparatus includes a pair of pleating rollers, means to rotate one of said pleating rollers, a first pair of support rollers in supporting contact with a first of said pair of pleating rollers and a second pair of support rollers in supporting contact with a second of said pair of pleating rollers. Each of said pleating rollers has a plurality of radially reduced sections. An elongated pleating finger member is positioned in at least a plurality of radially reduced sections, and means are provided to movably support each of said elongated pleating finger members.

24 Claims, 7 Drawing Sheets

PLEATING SYSTEM

CROSS-REFERENCE TO RELATED APPLICATIONS

This application claims the benefit of the subject matter of Provisional Patent Application No. 60/538,633, for a Pleating System, which was filed with the U.S. Patent and Trademark Office on Jan. 23, 2004. The entire disclosure and contents of the above application is hereby incorporated by reference.

GOVERNMENT INTEREST STATEMENT

NONE

FIELD OF THE INVENTION

The invention relates to a mechanism for high speed pleating, and more particularly, to an apparatus for the continuous high speed pleating of paper, such as Kraft paper, or the like.

SUMMARY

According to a first broad aspect of the invention, there is provided an apparatus for pleating paper comprising, a pair of pleating rollers, means to rotate one of said pleating rollers, a first pair of support rollers in supporting contact with a first of said pair of pleating rollers and a second pair of support rollers in supporting contact with a second of said pair of pleating rollers. Each of said pleating rollers have a plurality of radially reduced sections and an elongated pleating finger member is supported for being positioned in at least a plurality of radially reduced sections.

Means are provided to movably support each of said elongated pleating finger members. The elongated pleating fingers are parallel to each other and are selectably movable toward and away from each other to varying the height of pleats that are formed, and are movable toward and away from said pleating rollers. The elongated pleating fingers remain parallel to each other in all positions.

Advantageously, the support rollers are offset from each other on the order of about 8 degrees. In an embodiment of the invention, the angle formed between a first line drawn through the center of a first support roller to the center of a pleating roller and a second line drawn through the center of each of said pleating rollers is about 4 degrees.

The apparatus includes paper feed means for feeding paper, preferably Kraft paper, between the pleating rollers.

In an embodiment of the invention, the pairs of elongated pleating fingers are spaced from each other by a distance that is approximately equal to the height of pleats produced by said apparatus for pleating paper.

Each of the elongated pleating fingers has a radial region at its proximal end for providing a decreasing space between pleating fingers as paper enters the space between pairs of elongated pleating fingers. In a preferred embodiment of the invention, the radial region is rounded.

In an embodiment of the invention pairs of elongated pleating fingers are spaced apart by a lesser amount at their proximal ends than at their distal ends. Additionally, pairs of elongated pleating fingers are spaced apart by a first distance along a first region at the elongated fingers proximal end, and are spaced apart by a second distance along a second region. The second region extends from the first region to the elongated pleating fingers' distal end. In a preferred embodiment of the invention, the second distance is greater than the first distance, In another embodiment of the invention, a projection member is proximate the junction of said first region and said second region, and is movably supported to variably project into the space between the pairs of elongated pleating fingers. The projection member may project about 20 thousandths of an inch into the space between the pairs of elongate pleating fingers.

In an embodiment of the invention the pleating rollers are formed of a deformable material and are substantially flattened in the region of contact between said pleating rollers. The material of the pleating rollers can be about 80-durometer hardness rubber and the rollers can have a steel core.

In an embodiment of the invention a plurality of the radially reduced sections have a width of about 0.37 inches and the rollers have a first plurality of sections having a width of about 0.38 inches. A second plurality of sections has a width of about at least about one inch, and the rollers have a diameter of about 1.5 inches.

In an embodiment of the invention the length from the proximal end to the second region is about one inch and the length of the second region is about 3.5 inches. The total length of the first region and said second region is up to about five inches.

In an embodiment of the invention paper is pleated by feeding paper to a pair of pleating rollers. Drive means are provided to rotate one of said pleating rollers. A first of the pair of pleating rollers can be supported by a first pair of support rollers. A second of the pair of pleating rollers can be supported by a second pair of support rollers. Each of the pleating rollers has a plurality of radially reduced sections and an elongated pleating finger member is positioned in at least a plurality of radially reduced sections. Advantageously, each radially reduced section accommodates a pleating finger.

In an embodiment of the invention each of the elongated pleating finger members are movable in order to adjust the distance between elongated pleating fingers by a predetermined amount and thereby producing pleats of a corresponding predetermined height.

The process is initiated by unwinding Kraft paper from a continuous roll, feeding the Kraft paper to said pleating rollers and withdrawing pleated paper from said elongated pleating fingers.

BRIEF DESCRIPTION OF THE DRAWINGS

The invention will be described in conjunction with the accompanying drawings, in which.

Figure 6:
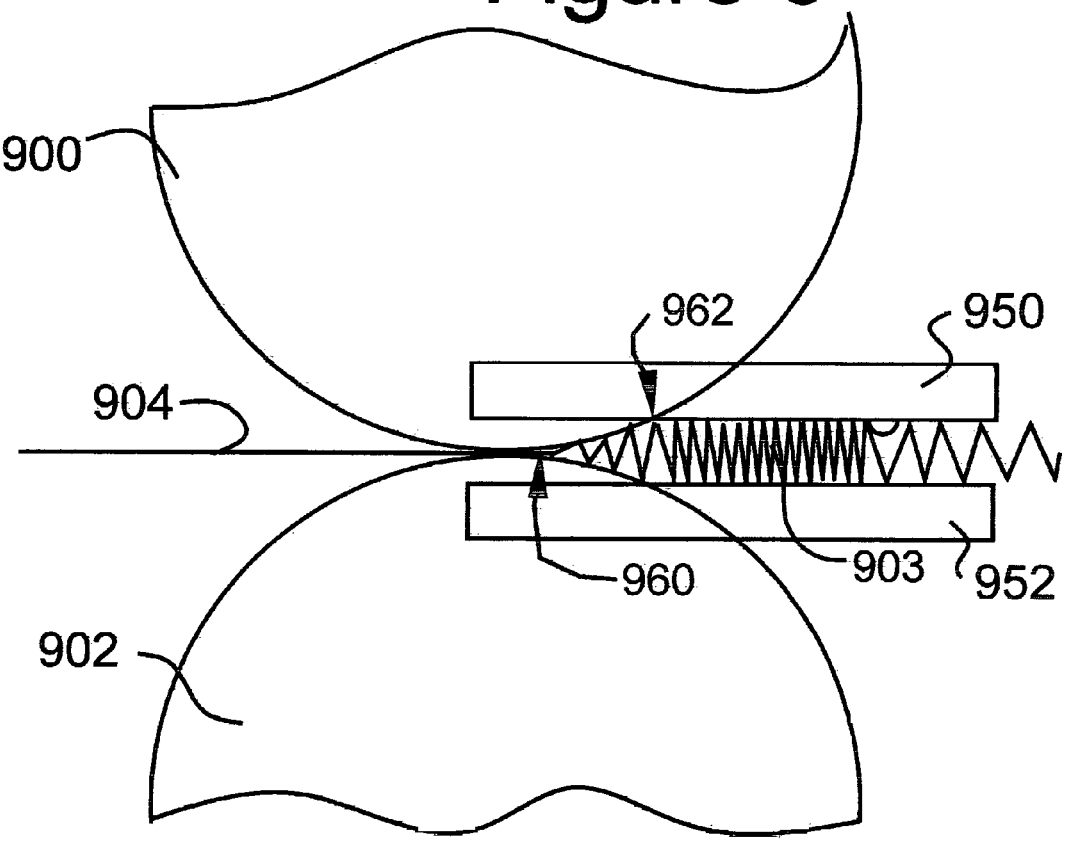

FIG, 5 is an enlarged view of the pleating region in accordance with an embodiment of the present invention;

FIG. 6 illustrates the use a pleating operation in which the pleating starts prematurely.

Figure 7:
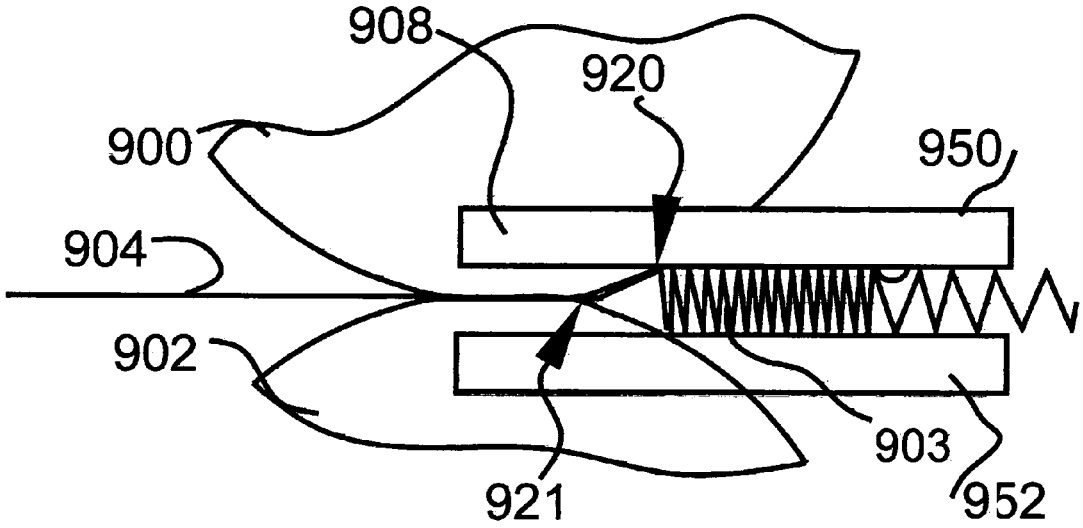
Figure 8:
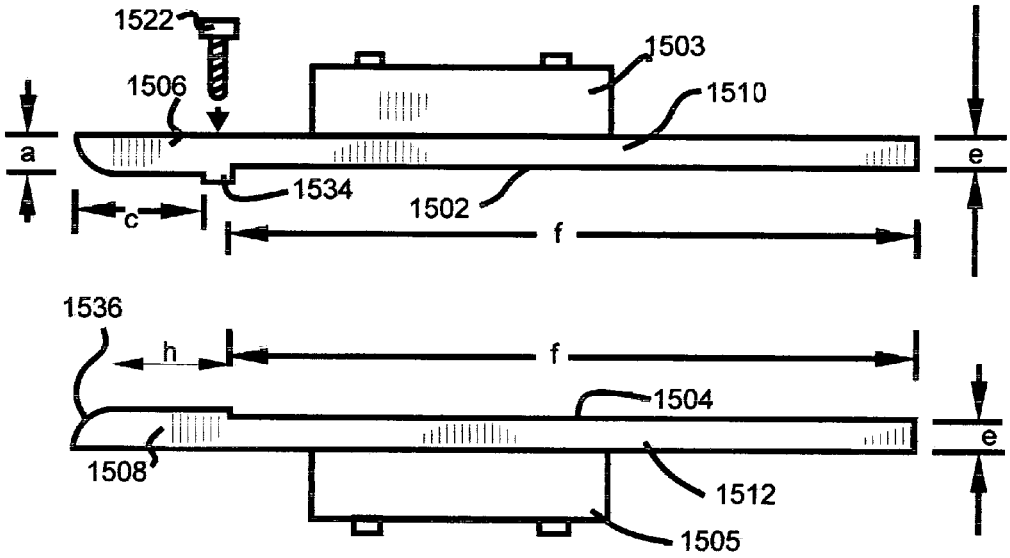
Figure 9:
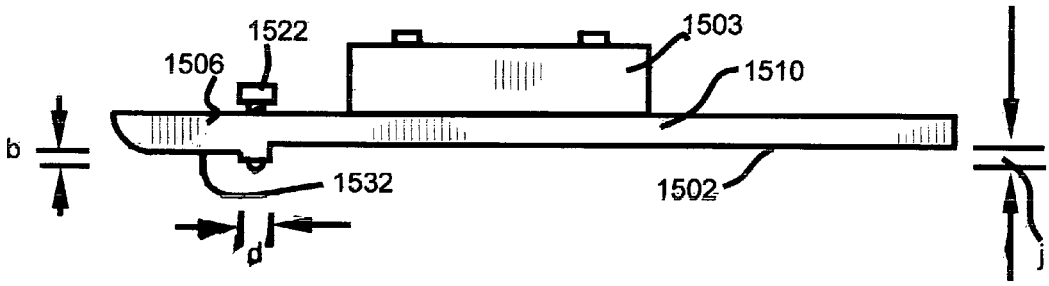

FIG. 7 is a schematic illustration of a pleating operation in accordance with an embodiment of the present invention;

FIG. 8 is a side schematic view of a pair of pleating fingers, in accordance with an embodiment of the present invention; and FIG. 9 side schematic view of the upper pleating finger of FIG. 8, showing the projection member projecting from the bottom of the pleating finger, in accordance with an embodiment of the present invention.

DETAILED DESCRIPTION

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, the term "offset" as applied to the relationship between support rollers and pleating rollers, refers the angle formed between a first line drawn through the center of a first support roller to the center of a pleating roller and a second line drawn through the center of a second support roller to the center of the pleating roller. As the terms are herein employed, an offset of 8 degrees between a pair of support rollers is equivalent to an offset of 4 degrees for each roller.

For the purposes of the present invention, the term "radial region" refers to a concave region, a rounded region, or a region having a tapered or gradually decreasing thickness.

For the purposes of the present invention, the term "continuous roll" means sheet paper wound about a core, that is paper that encircles or spirals an interior core member.

Description

Pleating devices have been in commercial use for over a hundred years and pleated fabrics have been used for apparel. Pleated paper has been used for filters such as automotive oil, air and gasoline filter media.

The use of pleated paper as a low cost, high volume void fill can be greatly enhanced if the paper can be repeated by a high-speed system that consistently produces pleats of a predetermined size. Pleat height is typically measured in terms of the normal distance, or right angle distance between a pair of parallel lines that touch the apices of the pleats. The hypotenuse of the pleat angle stays consistent but the apex angle and the pleat height can vary. The use of pleated Kraft paper for a void filter or pleated wrap material requires the formation of an acute angle and a sufficiently sharp crease at the apex to resist the migration of the pleats toward an obtuse angle. The system preferably generates pleats with an apex angle under 45 degrees, and more preferably, with an angle of less than 25 degrees.

Figure 1:
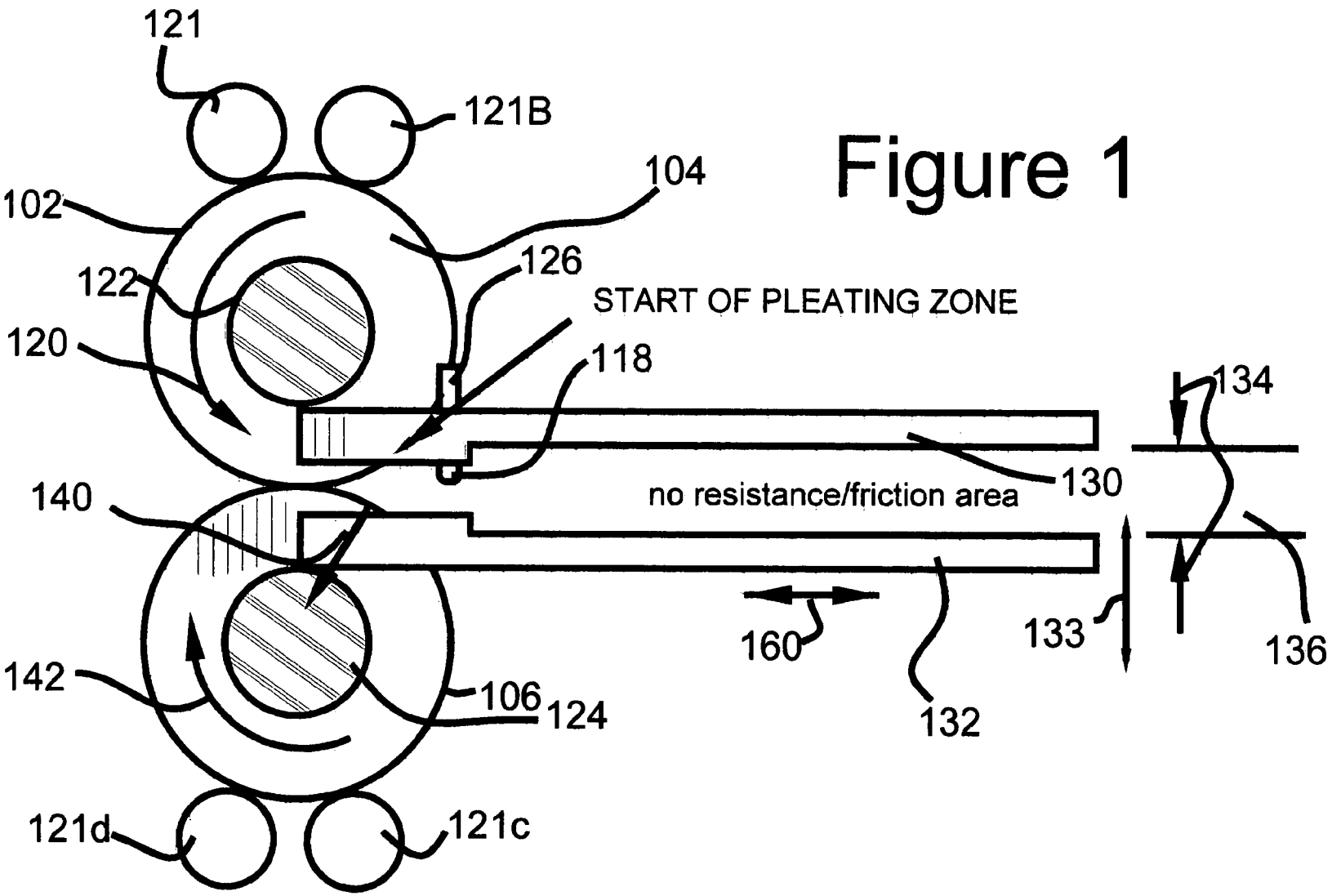
FIG. 1 is a schematic fragmentary illustration of a pleating mechanism in accordance with the present invention.

As shown in the embodiment of FIG. 1, the system, indicated generally as 100, includes a pair of counter-rotating pleating rollers, 104 and 106. The rollers are preferably about 80-durometer rubber mounted on a steel shaft 122 and 124 respectively. The durometer range may vary about +/−10%, but a variation of no greater than about +/−5% is preferred. The rollers can also be formed of other durable materials, such as steel. The backpressure generated by the pleating action is extremely high, and therefore it is desirable to use large diameter rollers in order to resist the bending or sagging of the rollers. However, it has now been found that the reliability and consistency of the pleating action can be greatly improved through the use of a small diameter roller. It can be desirable to produce pleated paper in 48-inch widths and thus the rollers can bow when under the pressure of the pleating action. Each roller 104 and 106 is reinforced by a dual set of 2-inch diameter rollers 121D, 121C, 121B and 121 respectively. The support rollers can be offset slightly upstream for the bottom support rollers and slightly downstream for the upper support rollers in order to counter the forward and backpressure created by the twisting action of the pleating rollers. The point of contact of the support roller and the pleating roller is preferably offset about four degrees thus generating a counterpressure indicated in respect to roller 106, by arrow 140. The angle is measured on the basis of a line drawn through the center of the two pleating rollers and a line drawn from the center of a pleating roller and the contact point between the pleating and support rollers. Roller rotation directions are indicated by arrows 142 and 120.

The pleating action is controlled or regulated by a pair of finger members 130 and 132 that are position in the key regions of the pleating rollers. The finger members are mounted such that the distance 136 between the fingers can be adjusted as indicated by arrows 133, or in the opposite direction from the arrows. The pleat height is substantially equal to the distance 136. If the pleat apices are crushed flat then the height is approximately equal to the distance between the pleat apices. The pleating action is facilitated by the use of a projection 118, on the finger 130. The fingers 130 and 132 are also adjustable forward and aft, that is, further into or out of the region between the rollers, as indicated by arrow 160. The projection can be on either finger, and preferably is on only one finger.

Figure 2:
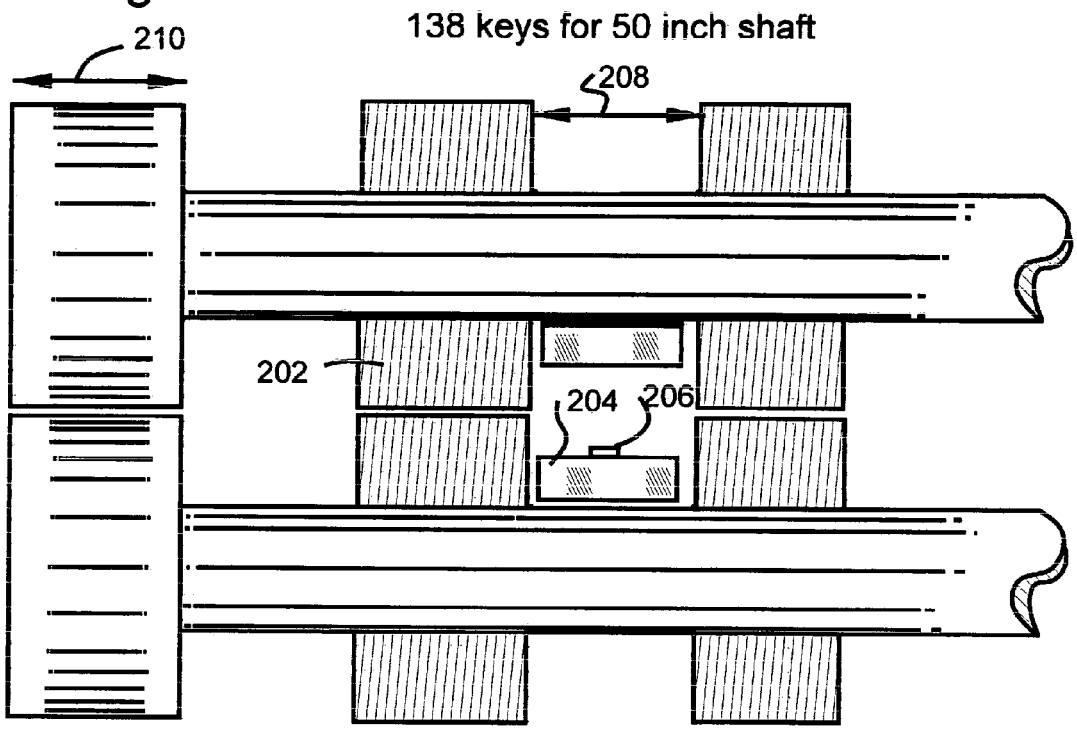
FIGS. 2 and 2*a* are fragmentary illustrations of the pleating rollers, partly in cross-section.

As illustrated in FIG. 2, the rollers 202 are spaced apart by a distance indicated as 208. The space is referred to herein as a key. The width of the rollers is indicated by arrows 210. The projection 206 on the finger 204 is preferably threaded such that it can project to a greater or lesser extent into the path of the pleats of the pleated paper.

Figure 2A:
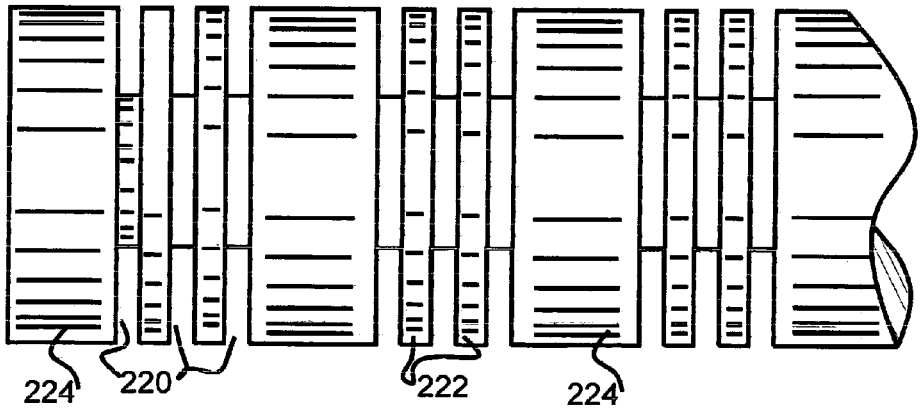

The embodiment of the invention, as illustrated in FIG. 2*a*, shows keys or spaces 220 between the rollers, 222 and 224. The fingers are positioned in each of these spaces. In this embodiment, two narrow rollers 222 are positioned to alternate with wide rollers 224.

Figure 3:
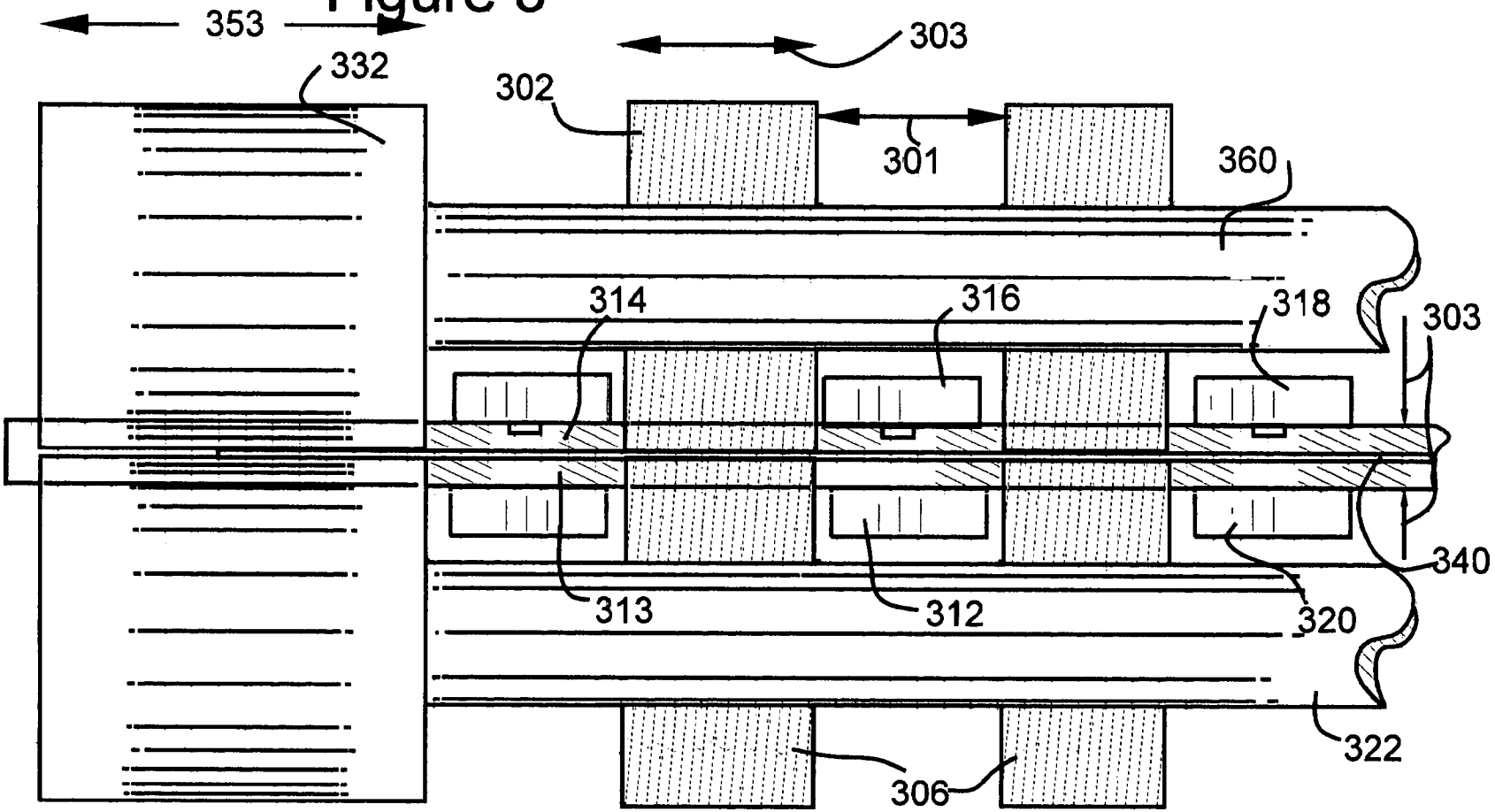
FIG. 3 is a fragmentary illustration of the pleating rollers, partly in cross-section, and showing pleats formed by the pleating rollers in accordance with an embodiment of the present invention.

As illustrated in the embodiment of FIG. 3 pleats are formed by the series of pleating rollers 302 and 306. The pleating rollers 302 can have keys or spaces, that can be spaced about approximately ⅜ to ½ of an inch as indicated by arrow 301, and the roller key width between fingers (312 316), is preferably about ⅜$^{th}$ of an inch. The unpleated sheet edge is indicated by the reference numeral 340. The upper section 314 of the pleats engages the projection of the fingers, 316 and 318 and correspondingly, the lower section 313 of the pleats engage the fingers 312 and 320. Arrows 303 indicated the pleat height. As illustrated in FIG. 3, the fingers indicated by reference numerals 312 and 320 are positioned in the gap between the rollers and the shaft 322, called the keys. The width of the narrow rollers 302 indicated by arrows 303 is about ⅜$^{th}$ of an inch, and the width of the wide rollers 332 is about 1.1 inches wide as indicated by arrow 353. The two narrower sections 302 are about 0.375 inches in width as indicated by arrow 303 and spaced about 0.365 inches, as indicated by arrow 301. The steel core shaft 360 is preferably about 1 inch in diameter and the pleating rollers 332 and 302 preferably have a diameter of about 1.5 inches. Advantageously, the dimensions are within 10% plus or minus of the preferred dimensions. The width of the fingers 316 is less than the space 301 between rollers in order to provide clearance between the fingers and the rollers. The width of the fingers can be about 0.25 inches.

Figure 4:
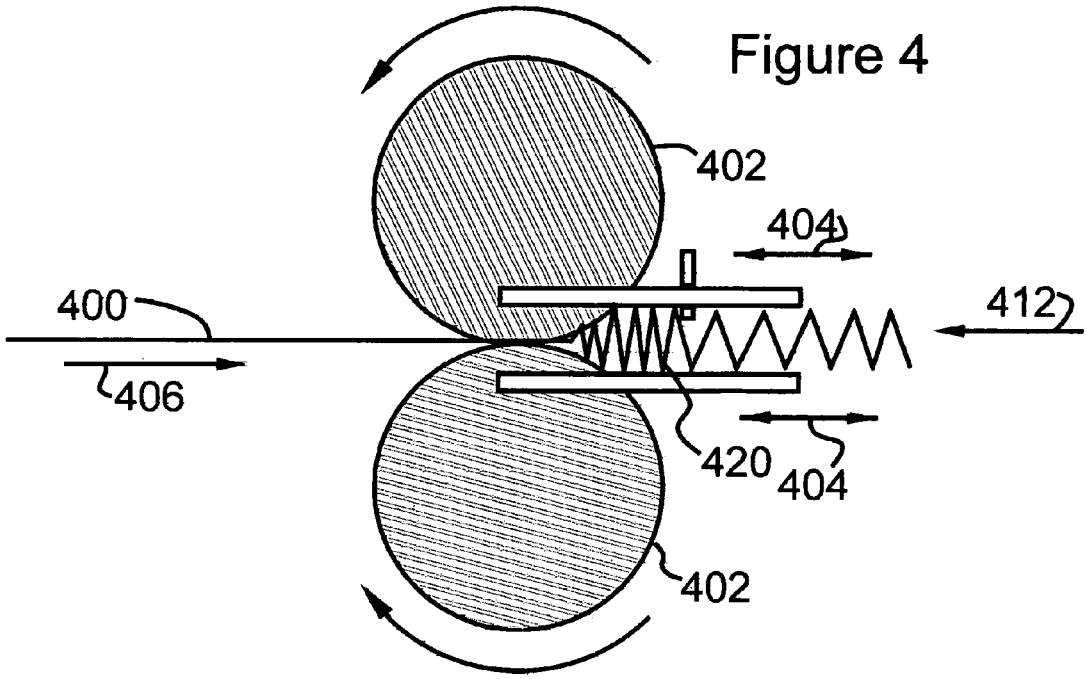
FIG. 4 is a schematic illustration of a pair of pleat rollers driving a sheet of paper in accordance with an embodiment of the present invention.

The embodiment of FIG. 4 shows a pair of pleat roller 402 driving a sheet of paper 400 in the direction of the indicated by the arrow 406. The backpressure is indicated by arrow 412. It should be understood that an equivalent backpressure is applied to each pleat roller. The pleating action begins in the region upstream and proximate the projections of the fingers. The formation of the pleats 420 can be adjusted by the movement of the fingers toward or away from the pleat rollers, as indicated by arrows 404.

Figure 5:
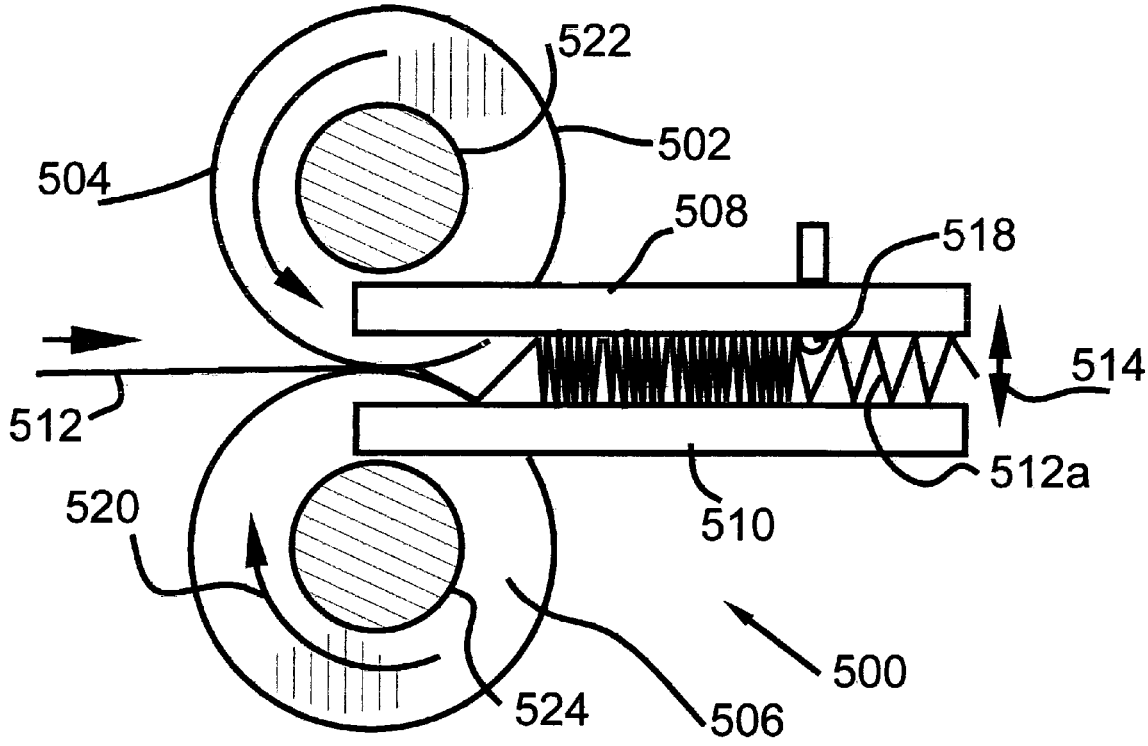

In the embodiment of FIG. 5 the pleating region is indicated generally as 500. The pleating rollers 504 and 506, are shown with their corresponding shafts 522 and 524. The direction of rotation is indicated by arrow 520. The fingers 508 and 510 are adjustable as indicated by arrows 514. The formed pleats are indicated by reference numeral 512*a*. The threaded member 518 is shown extending into the path of the pleats. The pleating action is shown to begin with the paper contacting the surface of a finger. The pleats are backed up or essentially closed due to the action of the threaded member 518 that projects into the path of the pleated paper. When the paper moves downstream of the project, the pleats can open to some extent.

The mechanism for driving the rollers may be gears, belts or other know driving mechanisms. Preferably, only one pleating roller is driven and the other rollers rotate due to the pressure applied to them by other rollers.

FIG. 6 illustrates the use a pleating operation in which the pleating starts prematurely. It is seen that pleating of the paper 904 begins at the exit point 960 from the pleating rollers 900 and 902. The pleats are compacted in region 903 until they reach the adjustable project between the fingers 950 and 952, and then can open up. In this type of sequence, the pleats may be defective and it may not be possible to obtain continuous pleating.

FIG. 7 illustrates the use of a pair of pleat rollers 900 and 902 form of a material, such as a rubber having a durometer hardness of about 80, such that the contact regions of each pair of rollers can flatten. As illustrated in FIG. 6, the peripheral surfaces of the rollers 900 and 902 between the points 960 and 962, can contact a plurality of pleat apices. It has been found that using rollers having a small enough diameter to minimize or negate the contacting action between the roller surface and a plurality of pleat apices, greatly increases the reliability of the pleating system, and facilitates the operation of the system at unexpectedly high out puts.

While the theory of what is happening or might happen during a pleating operation is not part of the invention, a discussion of the theory is provided for the purpose of attempting to provide a full understanding of what is happening or what might be happening. It should be understood that the description of the theory of the operation does not serve to limit the scope of the invention.

The pleating system as shown in FIG. 6, starts with fingers 950 and 952 respectively, manufacturing pleats with the pressure from rolls 900 and 902 respectively. The pleat-pack 903 is the point at which the pleats make vertical 0 degree apices. If the diameters of the pleating rollers 900 and 902 are large then the distance to the point of manufacture of the pleat-pack 903 becomes longer than the pleat height, which appears to allow the pleats to form on the rolls 900 and 902 rather than on the fingers 950 and 952. The arc of the rollers between the point 960 at which the paper 904 leaves the pleating roller and the point 962 where the paper first contacts the inner surface of the fingers 950 and 952 should be no longer than the pleat height.

As illustrated in the embodiment of FIG. 7, to further facilitate the desired pleating action an 80-durometer roller 900 and 902 is allowed to compress and deform substantially to a flat region, which inhibits pleating on the roll as, shown in FIG. 6. The flattening of the rollers is understood to facilitate the pleating operation by decreasing the arc of the roller between the point 921 at which the paper leaves the pleat rollers and the pleat point 920 at which pleating starts. The flattening of the rollers thus is sufficient to decrease the arc of the roller between the point 921 at which the paper leaves the pleat rollers and the pleat point 920 at which pleating starts.

FIG. 8 is an enlarged view of the finger assembly and provides preferred dimensions. It should be noted that the Kraft paper weight can be in the range from about 30 to 55 pounds per 3,000 sq. ft. Dimension a represents the height of a finger at the end proximal to the pleat roller. Dimension "a" is preferably about 0.23 inches.

Dimension "c"=0.8 inches, and represents the distance of the projection to the proximal end of the fingers. The diameter of threaded projection member 1522 is preferably about 0.15 inches. Distal end dimension "e"=0.215, and is noted to be less than the proximal end dimension. The finger length "f" is 3.5 inches and the fingers have a travel that is varied b6 sliding carriers 1505 and 1503 on tracks not shown. A radius section 1536 to reduce paper interference is preferably 0.225 inches. This leaves a pleating area "h" of about 0.575 inches which is preferred. FIG. 9 illustrates the projection member 1522 projecting from the lower surface of the upper finger 1510. Dimension "b" represents the extent to which the threaded projection member 1522 projects into the path of the pleats. The preferred dimension is about 0.020 inches. This projection or bump is variable and provides backpressure to the pleats.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart there from.

What is claimed is:

1. An apparatus for pleating paper comprising, a pair of pleating rollers, means to rotate one of said pleating rollers, each of said pleating rollers having a core shaft; at least one support roller in peripheral supporting contact with a first of said pair of pleating rollers and at least one support roller in peripheral supporting contact with a second of said pair of pleating rollers, each of said pleating rollers having a plurality of radially reduced sections, a plurality of pairs of elongated pleating finger members, a pair of elongated pleating finger member positioned in each of at least a plurality of radially reduced sections, and means to movably support each of said elongated pleating finger members.

2. The apparatus of claim 1, further comprising a first pair of support rollers and a second pair of support rollers, said first of said pair of support rollers being in peripheral supporting contact with said first of said pair of pleating rollers and said second pair of support roller being in peripheral supporting contact with said second of said pair of pleating rollers.

3. The apparatus of claim 2, wherein each of said support rollers are offset from each other on the order of about 8 degrees.

4. The apparatus of claim 2, wherein the angle formed between a first line drawn through the center of a first support roller to the center of a pleating roller and a second line drawn through the center of each of said pleating rollers is about 4 degrees.

5. The apparatus of claim 2, wherein a plurality of said radially reduced sections have a width of about 0.37 inches and said rollers have a first plurality of sections having a width of about 0.38 inches, and a second plurality of sections having a width of about at least about one inch, and said rollers have a diameter of about 1.5 inches.

6. The apparatus of claim 1, further comprising paper feed means for feeding paper between said pleating rollers.

7. The apparatus of claim 1, wherein each pleating finger of said pairs of elongated pleating fingers are variably spaced from each other by a distance that is approximately equal to the height of pleats produced by said apparatus for pleating paper.

8. The apparatus of claim 7, wherein each of said elongated pleating fingers has a radial region at its proximal end for providing a decreasing space between pleating finger as paper enters the space between pairs of elongated pleating fingers.

9. The apparatus of claim 8, wherein said radial region is rounded.

10. The apparatus of claim 7, wherein said pairs of elongated pleating fingers are spaced apart by a lesser amount at their proximal ends than at their distal ends.

11. The apparatus of claim 10, wherein said pairs of elongated pleating fingers are spaced apart by a first distance along a first region, said first region being at said elongated fingers proximal end, and being spaced apart by a second distance along a second region, said second region extending from said first region to said elongated pleating fingers' distal end, said second distance being greater than said first distance.

12. The apparatus of claim 11, further comprising a projection member, said projection member being positioned proximate the junction of said first region and said second region, and being movably supported to variably project into the space between said pairs of elongated pleating fingers.

13. The apparatus of claim 12, wherein said projection member projects about 20 thousandths of an inch into the space between said pairs of elongated pleating fingers.

14. The apparatus of claim 11, wherein said elongated pleating fingers are parallel to each other and are selectably movable toward and away from each other to vary the height of pleats that are formed, and are movable toward and away from said pleating rollers, said elongated pleating fingers remaining parallel to each other in all positions.

15. The apparatus of claim 14, wherein the length from said proximal end to said second region is about one inch and the length of said second region is about 3.5 inches and the total length of said first region and said second region is up to about five inches.

16. The apparatus of claim 1, wherein said pleating rollers being a deformable material and being substantially flattened in the region of contact between said pleating rollers.

17. The apparatus of claim 16, wherein said pleating rollers are formed of about 80 durometer hardness rubber and have a steel core.

18. The method of pleating papers comprising;

a—feeding paper between a pair of pleating rollers, b—peripherally supporting a first of said pair of pleating rollers with at least a first support roller, c—peripherally supporting a second of said pair of pleating rollers with at least a second support roller, each of said pleating rollers having a plurality of sets of keys, said keys being radially reduced sections, a pair of elongated pleating finger members positioned in each of at least a plurality of said sets of keys, d—adjusting the distance between pairs of elongated pleating fingers by a predetermined amount and thereby producing pleats of a predetermined height, and e—adjusting the forward and aft position of said pairs of elongated pleating fingers thereby varying the extent to which pairs of elongated pleating fingers project into the keys.

19. The method of claim 18, said pair of pleating rollers being of a deformable material and each being substantially flattened by the other pleating roller in the region of contact between said pair of pleating rollers.

20. The method of claim 19, further comprising the step of unwinding Kraft paper from a continuous roll and feeding said Kraft paper to said pleating rollers and withdrawing pleated paper from said elongated pleating fingers.

21. An apparatus for pleating paper comprising, a pair of pleating rollers, means to rotate one of said pleating rollers, each of said pleating rollers having a core shaft, each of said pleating rollers having a plurality of sets of keys, said keys being radially reduced sections and each set having at least two keys, a plurality of pairs of opposing elongated pleating fingers, a pair of opposing elongated pleating finger members positioned in each of at least a plurality of sets of keys, and means to movably support each of said elongated pleating finger members, and at least one support roller in peripheral supporting contact with a first roller of said pair of pleating rollers.

22. The apparatus of claim 21, wherein the distance between pairs of fingers is adjustable and said pairs of fingers being adjustable forward and aft, whereby the height of pleats can be varied and the extent to which pairs of finger extend into and out of the region between the rollers can be varied.

23. The apparatus of claim 21, wherein the axial distance between keys of a first set of keys is greater that the axial distance between a second set of keys.

24. The apparatus of claim 23, further comprising a plurality of first set of keys and a plurality of second set of keys.

* * * * *